United States Patent [19]

Schilger et al.

[11] 4,387,544

[45] Jun. 14, 1983

[54] REINFORCING STRIPS FOR PRE-CAST CONSTRUCTION ELEMENTS

[76] Inventors: Herbert K. Schilger, 916 Thornycroft N.W., Calgary, Alberta; John S. Hall, 881 Thorndale Dr., Ottawa, Ontario, both of Canada

[21] Appl. No.: 165,772

[22] Filed: Jul. 3, 1980

Related U.S. Application Data

[63] Continuation-in-part of Ser. No. 42,332, May 25, 1979, abandoned.

[51] Int. Cl.[3] ..... E04B 5/23

[52] U.S. Cl. ..... 52/405; 52/600; 52/601

[58] Field of Search ..... 52/319–323, 52/602, 367, 324, 325, 326, 371, 372, 600, 601, 327, 328, 329, 330–333, 335, 336, 724, 725, 737–739

[56] References Cited

U.S. PATENT DOCUMENTS

| | | | |
|---|---|---|---|
| 757,962 | 4/1904 | Randall | 52/724 |
| 1,914,417 | 6/1933 | Goldsmith | 52/329 |
| 2,270,672 | 1/1942 | Heeren | 52/489 |
| 3,813,834 | 6/1974 | Bradley | 52/223 R |

FOREIGN PATENT DOCUMENTS

| | | | |
|---|---|---|---|
| 1057507 | 3/1954 | France . | |
| 1089371 | 3/1955 | France . | |
| 1234803 | 10/1960 | France | 52/324 |
| 439656 | 12/1967 | Switzerland | 52/321 |

*Primary Examiner*—John E. Murtagh

[57] ABSTRACT

A novel metallic reinforcing strip as described for use in cementitious construction elements. The reinforcing strip in one form comprises an elongated unitary strip having a substantially flat central web portion, with the side edges of the web merging by way of rounded corners of small radius into flange portions extending away from the central web. At least the free longitudinal edges of the flanges are inclined inwardly and these longitudinal flange edges have longitudinally spaced rounded depressions of small radius pressed downwardly therein. These depressions cause associated deformation of the flanges less than the full depth of the flanges, leaving substantially undeformed longitudinal portions of the flanges adjacent the central web and outwardly bowed portions of the flange edges between the rounded depressions. These contours provide a double curvature providing maximum membrane resistance within the reinforcing strip with minimum bending or flexing stresses. When these flanges with the double curvature are embedded in the construction element, the curvatures provide a mechanical interlock in both longitudinal and lateral directions, enhancing the strength and rigidity of the element.

5 Claims, 24 Drawing Figures tion element and the flat metal surface adjacent the edge of the construction element provides an excellent nailing or fastening surface.

According to one particularly preferred embodiment of the invention, the construction element is in the form of a building panel of any convenient size. A particularly convenient panel is one having a width of about 16 inches, a length of about 8 feet and a thickness of about 1 inch. Such a panel has extending along the length thereof at least one, and preferably two, integrally formed set cementitious projections which serve as reinforcements, as well as nailing strips. The metal reinforcing strip is embedded in the edge face of such projections remote from the panel portion and the projections preferably have inclined side walls terminating in an end edge containing the reinforcing strip. A typical panel of this type weighs about 117 pounds and can be handled by one man.

Of course, panels of the above type may be manufactured in long sections and may be conveniently cut to any desired length. Long panels must, of course, be lifted with some form of mechanical lifting device.

According to another preferred embodiment, the construction element comprises a panel unit having integrally formed on one face thereof at least one, and preferably two set cementitious projections extending along the length thereof. These projections have parallel side walls adjacent the panel and these parallel side walls terminate remote from the panel in outwardly directed and inwardly facing ledges which are parallel to and spaced from the panel face. These ledge faces form part of an enlarged outer portion with the outer edge of this outer portion containing the metal reinforcing strip. This enlarged outer portion preferably has inwardly tapering side walls between the ledge faces and the outer edge containing the metal reinforcing strip. Rigid cellular insulation blocks are mounted between the panel face and the ledge faces, being retained in position by the panel face, the parallel side walls of the projections and the ledge faces.

Such units with the integral insulation can be used for foundation walls, exterior walls, permanent formwork and floor and roof panels. A typical 16 inch wide by 8 foot long panel of this type weights approximately 128 pounds and has a thermal resistance of R12.

According to yet another embodiment of the invention, it may comprise a channel beam member having the typical central web with side flanges. The entire beam is cast from set cementitious material and the metal reinforcing strips are mechanically fixed to the outer edges of the flanges. Such beams can be used for permanent formwork, as regular beams and joists, etc.

The invention is illustrated by the following drawings in which:

FIG. 17 is a permanent formwork incorporating the beams according to this invention;

FIG. 18 is a further schematic view of a permanent installation incorporating the beams of the invention; and FIG. 19 is a further view of a permanent girder and beam installation incorporating the beams of the invention.

Figure 1:
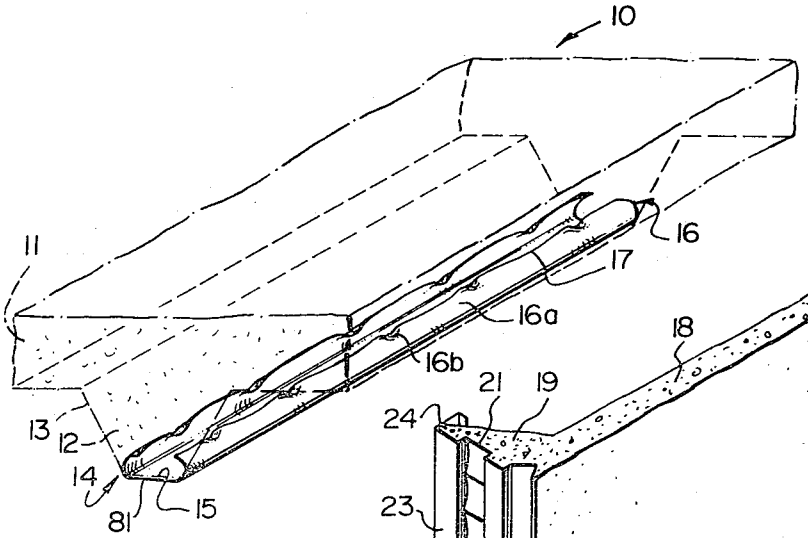
FIG. 1 is a schematic isometric view of part of a construction element according to this invention showing a reinforcing strip.
Figure 1A:
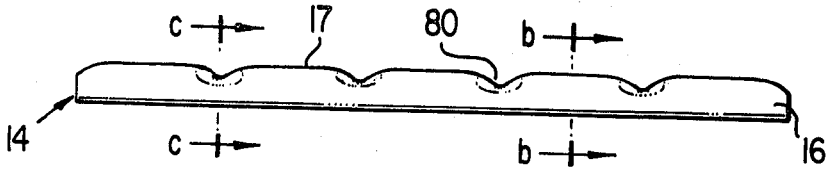
FIG. 1A is a longitudinal sectional view of the reinforcing strip of FIG. 1.

FIG. 1 shows one embodiment of the reinforcing strip of this invention in operational position embedded in a set cementitious, e.g. lightweight concrete, construction element. The particular construction element 10 shown in this view includes a panel portion 11 having a longitudinally extending projection 12 integrally formed therewith and extending outwardly from one face of the panel portion 11. This longitudinal projection 12 has tapered side walls 13 terminating in a flat outer face 15. A reinforcing strip 14 of this invention is embedded in the projection 12 in the region of face 15.

The reinforcing strip 14 has a central generally flat web portion 81 with the side edges thereof merging into side flanges 16. These side flanges are of a curved cross-section as can be seen from FIGS. 1B and 1C with the free edges of the flanges curving inwardly toward each other.

The free edges of the flanges also have rounded indentations 80 pressed downwardly therein and these depressions cause associated deformation of the flanges less than the full depth of the flanges leaving substantially undeformed longitudinal portions adjacent the central web 81. Between the depressions 80 are outwardly bowed free edge portions 17.

Figure 1B:
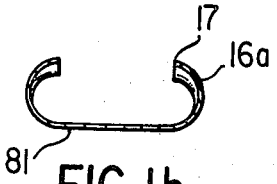
FIG. 1B is a cross-section along line BB of FIG. 1*a;*
Figure 1C:
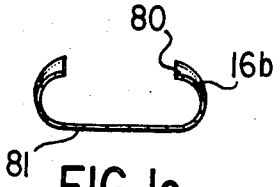
FIG. 1C is a cross-section along line CC of FIG. 1A.

FIG. 1B shows a cross-section through an outwardly bowed free edge portion 17 and the general cross-sectional shape of the flange at that point is shown by the numeral 16*a*. In FIG. 1C can be seen the effect of a rounded depression 80 on the cross-sectional shape with the portion of the flange 16*b* adjacent the free edge being more sharply bent. However, the portion of the

REINFORCING STRIPS FOR PRE-CAST CONSTRUCTION ELEMENTS

BACKGROUND OF THE INVENTION

The present invention relates a metal reinforcing strip for pre-cast construction elements and is a continuation-in-part of application Ser. No. 06/042,332, filed May 25, 1979, now abandoned.

Modern building construction includes many types of materials for floor and roof decks, partitions, walls, ceilings and the like and up until the present, no type of construction has been designed which has been capable of equalling wood for flexibility of application, ease of erection and initial cost. However, with the high labour costs of today and inflated wood prices, cheapness of initial cost is no longer a positive factor in selecting wood as a construction material. Furthermore, wood has always had some drawbacks, the principal one being that it is readily combustible and involves, therefore, a fire hazard which makes its use prohibitive in many circumstances. Another objectional feature of wood is that unit for unit it does not have the structural strength of steel. Moreover, wood is subject to deterioration.

There has, therefore, been a great interest in materials which can be used in place of wood and, in particular, materials which can include the advantages of wood in terms of weight per unit, ease of cutting and nailability. There has been a considerable interest in light-weight concrete for this purpose and it does have the advantages of lightness and good insulating properties, but it is very poor in strength characteristics as well as in its ability to retain nails.

It is, therefore, an object of the present invention to provide a novel light gauge metal reinforcing strip for use in precast building construction elements, particularly for use in light-weight concrete to give the concrete strength characteristics and nail retaining characteristics.

SUMMARY OF THE INVENTION

The present invention in its broadest aspect relates to a metallic reinforcing strip for mechanically embedding in cementitious construction elements. One embodiment of the strip comprises an elongated unitary strip having a substantially flat central web portion, with the side edges of the web merging by way of rounded corners of small radius into flange portions extending away from the central web. At least the free longitudinal edges of the flanges are inclined inwardly and these longitudinal flange edges have longitudinally spaced rounded depressions of small radius pressed downwardly therein. These depressions cause associated deformation of the flanges less than the full depth of the flanges, leaving substantially undeformed longitudinal portions of the flanges adjacent the central web and outwardly bowed portions of the flange edges between the rounded depressions. These contours provide a double curvature providing maximum membrane resistance within the reinforcing strip with minimum bending or flexing stresses.

It is particularly preferable that substantially the entire flange areas be curved so that there is a double curvature development. This double curvature along with a parabolic profile at the points of maximum sheer forces ensures maximum rigidity and load transfer of the reinforcing strip even when made from light gauge metal. Furthermore, with the above design, the geometry of the shape changes in proportion to the applied forces resulting in constant tension or compression in the metal. The result is the development of membrane resistance within the reinforcing strip while minimizing bending or flexing stresses. In order to maximize the effects of the double curvature, it is preferable that at least 50% of a cross section through the reinforcing strip be curved, these curved portions acting in resisting forces on the reinforcing strip and in restraining the flat portions of the strip.

Another embodiment of the strip is in the form of an elongated unitary strip having a pair of space, parallel face strips with inner and outer side edges. These inner edges merge by way of rounded corners of small diameter into inwardly directed side flanges which are inwardly divergent. A web portion joins the inner ends of the flanges by way of rounded corners of small diameter and this web portion has a series of scallop-like contours comprising a series of inwardly bowed portion of large diameter interconnected by outwardly bowed portions of small diameter, whereby a double curvature is developed providing maximum membrane resistance within the reinforcing strip with minimum bending or flexing stresses.

The reinforcing strips of this invention have a particular advantage in being capable of being made from a relatively light gauge metal, e.g. about 14 to 30 gauge sheet steel, preferably galvanized sheet steel. For most construction purposes, the strip can be made from about 20 to 30 gauge sheet steel, with material heavier than 20 gauge being used for major structural components. The reinforcing strips are usually formed by a rolling technique, with cold rolling being particularly preferred in terms of strength characteristics of the strip.

A typical reinforcing strip made from 20–30 gauge galvanized steel has a central web portion about $\frac{3}{4}$–$1\frac{1}{2}$ inches wide with flanges having a depth of about $\frac{3}{8}$–$\frac{3}{4}$ inch.

The rounded depressions along the flange edges are usually spaced longitudinally about 1–2 inches, but there can also be a relationship between the spacing of these rounded depressions and the width of the central web. Generally the longitudinal spacing of the depressions should be no more than twice the width of the web and is typically no less than the width of the web.

The rounded depressions typically extend downwardly about $\frac{1}{8}$–$\frac{1}{4}$ inch below the outwardly bowed flange portions.

The cementitious material may be practically any type of concrete from very light weight concrete to regular concrete. Usually the concrete has a density in the range of about 50 to 150 pounds per square foot. A particularly preferred material is a cellular "sand-light-weight" structural concrete having a density of about 100 lb./sq. ft. and compressive strength of about 1200 psi.

The reinforcing strips are positioned in a mold so that they are embedded in the concrete when a construction element is formed with the flange portions including the areas of double curvature being embedded. The flat portion or portions of the reinforcing strip is adjacent the surface of the construction element. In this manner the double curvature provides a mechanical interlock with the concrete in both longitudinal and lateral directions, the shape of the reinforcing strip provides considerable additional strength and rigidity for the construcflange adjacent the central web 81 remains substantially unchanged.

The generally inward curvature of the side flanges 16 provide a very close mechanical interlock when the concrete cures and this interlock together with the double curvatures of the reinforcing strip provide a unique combination in terms of resistance to longitudinal slippage, while providing strength and rigidity within the construction element. In other words, the reinforcing strips become an integral part of the construction element in terms of strength and load carrying capacity as well as in the ability to retain nails. The nails can be driven through the metal strip and into the concrete with considerable ease and the nails are firmly held by the concrete. Of course, self-tapping screws may alternatively be used.

Figure 2:
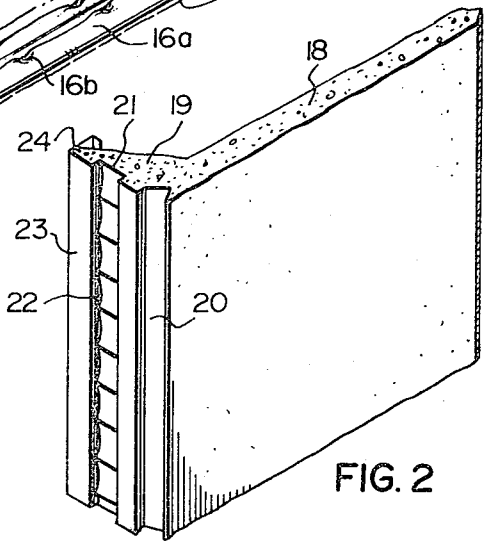
FIG. 2 is a partial view of a stud according to the invention showing a reinforcing end.

An alternative embodiment incorporating the same principal is shown in FIG. 2. This arrangement includes a concrete panel section 18 with an end flange 19 having a special galvanized steel reinforcing member mechanically locked thereon. The reinforcing member includes a V-slot 20 adjacent one edge, which receives the edge of an adjacent panel. It also includes a mechanical interlock and reinforcing section in the form of a recessed undulating portion 21 joined to outwardly flaring side walls 22. These side walls 22 join flat face portions 23 and 23*a*, with the outer edge of face 23 connecting to flange 24.

Figure 2B:
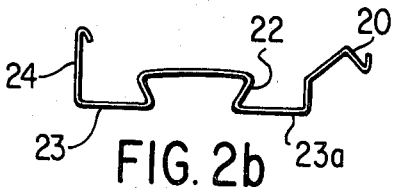
FIG. 2B is a cross-section of the reinforcing strip of FIG. 2.
Figure 2A:
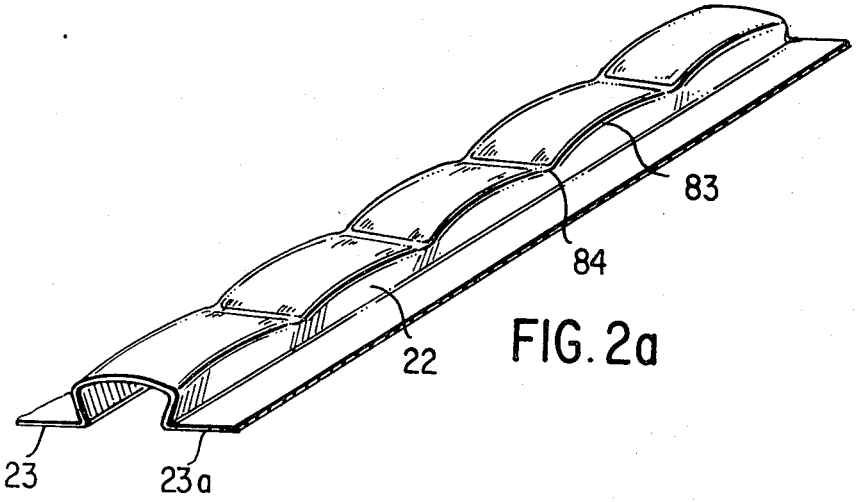
FIG. 2A is a schematic isometric view of a portion of the reinforcing strip of FIG. 2.

The shape of the undulations or scallops can be more clearly seen from FIG. 2A in which there is shown the inwardly divergent flanges 22 and a central inner web portion 21 joining the inner ends of the flanges 22 by way of rounded corners of small diameter. The web portion 21 has a series of inwardly bowed portions of large diameter 83 interconnected by outwardly bowed portions of small diameter 84, whereby once again the double curvature is developed providing maximum membrane resistance within the strip with minimum bending or flexing stresses.

The reinforced end portions 19 can form vertical studs in wall construction, with the flanges 24 forming convenient nailing strips. Alternatively, these panels can form floor sections with the flanges 24 resting on support beams.

Figure 3:
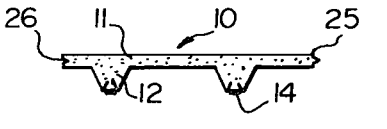
FIG. 3 is a sectional view of a panel unit according to the invention.

FIG. 3 shows one particularly preferred embodiment of the invention in the form of a construction panel of variable width and length. The structural unit 10 has a main panel section 11 which is typically about 1 inch thick with a tongue 25 at one side and a groove 26 at the other side of the panel for tongue and groove fit between panels. Formed integrally with the panel 11 are a pair of tapered longitudinal projections 12 with the reinforcing strips 14 of the invention mounted in the outer faces thereof.

Figure 4:
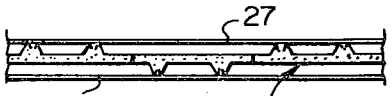
FIG. 4 is a sectional view of a firewall using panels according to the invention.
Figure 5:
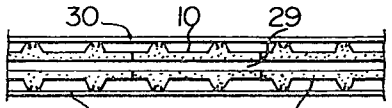
FIG. 5 is a sectional view of a further firewall incorporating the panels of the invention.

FIG. 4 shows how the panels of FIG. 3 can be used for constructing a fire separation wall having a one hour rating. The panels are alternated in direction as shown in FIG. 4 such as to give approximately a 4 inch spacing between wall panels 27 and 28. These panels 27 and 28 can be constructed from plasterboard or any other type of fire resistant building material. A wall construction having a two hour fire rating is shown in FIG. 5. Here a double row of panels according to the invention is used mounted back to back with a space 29 between them. Fire retardant wall panels 30 and 31 are mounted on the outer faces of the units 10 and with this arrangement the panels 30 and 31 are spaced by a distance of approximately 6 inches.

Figure 6:
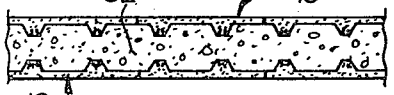
FIG. 6 is a heavy structural firewall incorporating the panels of the invention.

An even stronger firewall can be constructed by utilizing the smooth faces of the structural units as outer wall faces as shown in FIG. 6. Here the projection faces are turned inwardly and the space 32 between the panels 10 is filled with concrete or other material to make a solid fireproof structure.

Figure 7:
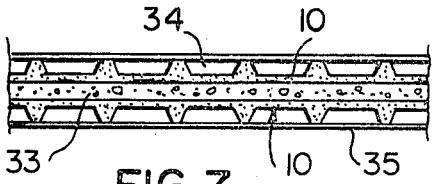
FIG. 7 is another form of permanent firewall incorporating the panels of the invention.
Figure 8:
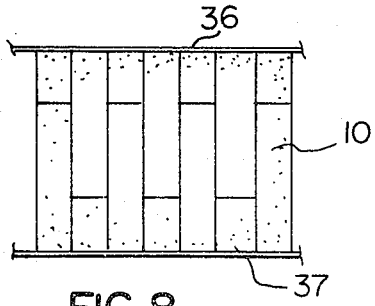
FIG. 8 is an elevation view of the panels of the invention in assembled position.

FIG. 7 shows a structural arrangement quite similar to FIG. 5 for making permanent walls with the panels 10 mounted back to back with a space 33 therebetween filled with concrete or other suitable material. Since in this embodiment the projections 12 are turned outwardly, wall panels 34 and 35 are fixed to these outward projections 12. FIG. 8 shows a typical installation using the structural units of the invention and they can conveniently be supported by top and bottom tracks 36 and 37 for constructing a wall or partition.

Figure 9:
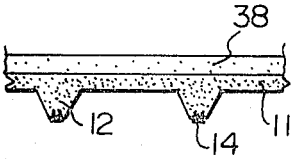
FIG. 9 is a sectional view of a panel according to the invention with a topping layer thereon.
Figure 10:
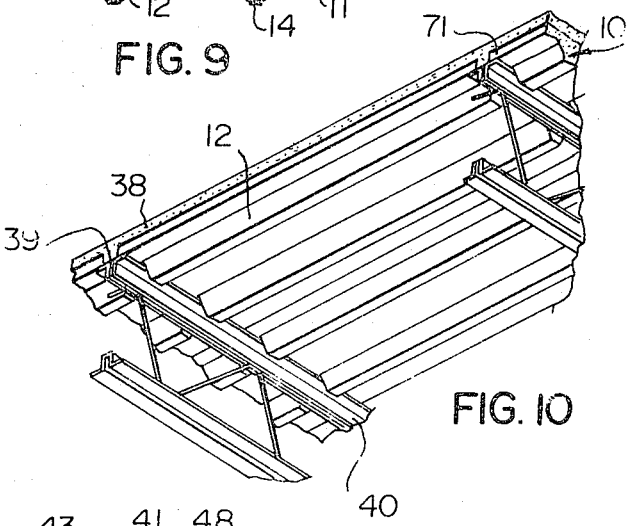
FIG. 10 is an isometric view from below of a floor structure incorporating the panels of the invention.

FIGS. 9 and 10 show how the structural unit of FIG. 3 can be utilized as a form and permanent floor panel. Thus, the structural units 10 are supported at their ends by support beams 40 as shown in FIG. 10, the structural units having gaps 39 between the ends thereof. A cementitious floor 38 is then poured on top of the panels 10 which serve as a form and permanent support structure of the floor. Although open web steel joists are shown in FIG. 10, the structural units of this invention can be used as permanent floor panels up to at least 6 feet span between Hambro joists, steel beams, precast beams, concrete walls, masonry walls, wood walls, wood beams, etc.

The reinforcing strip of this invention has unique capabilities in floor panels of the above type. Thus, most reinforcement systems having light plain reinforcements of the smaller dimensions e.g. $\frac{1}{4}$ inch diameter and less tend to exhibit bond slippage at yield. This represents a very serious disadvantage. Experiments conducted with impact load confirm that regular reinforcement and decking behave in a similar manner under yield causing rapid localized rotation, high stresses and concrete spalling. On the other hand, utilizing the reinforcing strips of the present invention a floor section under impact load developed a curvature and numerous small cracks without failure in the concrete and, particularly with no bond slippage. Thus, with the usual reinforcing materials, at the yield point the steel elongates and "necks", resulting in the reinforcement pulling out of the concrete. Such does not tend to happen with the reinforcing strip of this invention.

Figure 11:
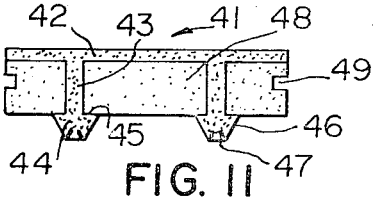
FIG. 11 is a sectional view of a building element illustrating a further embodiment of the invention.
Figure 12:
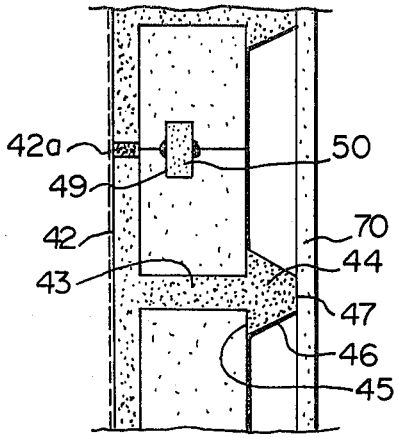
FIG. 12 is a plan view of a wall construction incorporating the panel of FIG. 11.

Yet another embodiment of the invention is illustrated in FIG. 11 and this represents a fully insulated structural unit which may, for instance, have an R12 thermal resistance. This structural unit 41 has a concrete panel portion 42, typically of 16 inch width and variable length, typically 8 feet. Integrally formed with one face of panel 42 are a pair of longitudinal projections 43 having parallel side walls for a distance of several inches from panel 42. These parallel side walls terminate in ledge faces 45 which are parallel to the panel faces. These ledge faces 45 are part of a large outer projection 44 having tapered side walls 46 and an outer face 47. The metal reinforcing strip of the invention 14 is mounted in face 47 in the manner described hereinbefore. The side faces of the projections 43 and the ledge faces 45 serve to lock in position rigid insulating blocks 48, e.g. polystyrene blocks. Slots 49 are provided in the ends of these insulating blocks and these are joined by means of splines 50 as shown in FIG. 12. This arrangement can conveniently be used for such items as foundation walls, exterior walls, permanent formwork and floor and roof panels up to 12 foot spans. FIG. 12 is a view of a foundation wall and the joints 42*a* between the concrete panels 42 may, if desired, be sealed by means of cement or a mastic sealer and the entire outer surface may be covered by a bituminous coating. An inner wall panel 70 is fixed to the faces 47 by means of any suitable fasteners.

Figure 13:
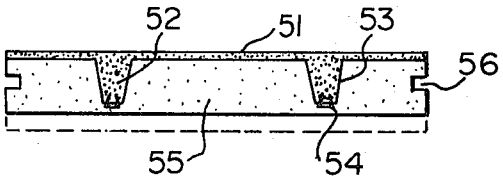
FIG. 13 is a sectional view of a panel embodying yet another feature of the invention.
Figure 14:
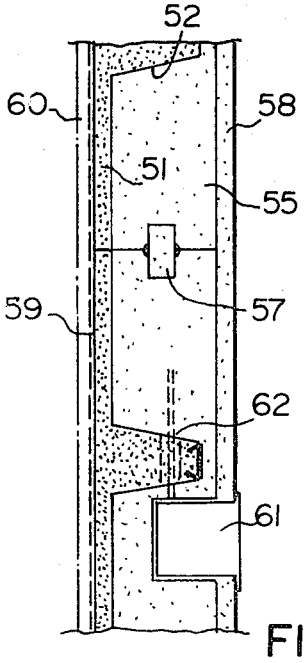
FIG. 14 is a plan of a wall construction incorporating the panel of FIG. 13.

Yet another embodiment of the invention is shown in FIG. 13 which is generally similar to the embodiment of FIG. 3 in that it includes a concrete panel portion 51 typically having a width of about 24 inches and a variable length, typically about 8 feet. In this case a quite thin panel portion 51 can be used, for instance having a thickness of about ½ inch and relatively long intergral projections 52 with tapered side walls 53 are formed on one side of the panel. The projections 52 have outer faces 54 incorporating the reinforcing strips 14 of the invention. In this embodiment the projections 52 are fully embedded in a rigid insulating block 55 having slots 56 in the ends thereof. These units are joined as shown in FIG. 14 by means of a spline 57. The face of the panels 51 may be conveniently coated with building paper 59 and an exterior finish 60. The exposed face of the insulating block 55 can be covered by means of a construction panel 58, e.g. a plasterboard panel forming an interior wall face. Household services can be installed directly into the rigid foam block and the projections 52 may contain knock-out openings 62 for electrical cables, etc. Electrical outlet boxes 61 can easily be formed in the wall panel 58 and the insulation 55. These units can be used for constructing exterior walls, permanent formwork, roof panels and foundation walls.

Figure 15:
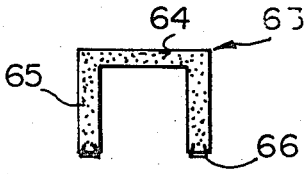
FIG. 15 is a channel member incorporating the invention.
Figure 16:
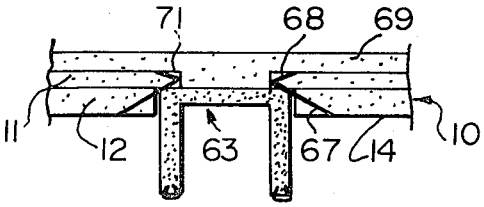
FIG. 16 is a schematic view showing an open system construction for residential use.

Yet another alternative embodiment of the invention is illustrated by FIG. 15. Here is shown a channel member 63 having a central web 64 with side flanges 65 and the reinforcing strips 14 of the invention mounted in the end faces 66 of the flanges 65. A typical 8 foot long panel of this type weights only 107.6 pounds. These channels can be used for many construction purposes and FIG. 16 shows a typical installation for low-rise residential construction. Here the channel 63 is serving as a support beam for panel members 10 of the invention. This embodiment also shows how the reinforcing strip 14 may be arranged in the end of a panel member used as a floor element. Thus, the longitudinal projection 12 shorter than the panel portion 11, providing a projecting lip 71 which rests on the beam 63. In order to reinforce the projecting lip 71, the reinforcing member 14 is first bent upwardly to form the incline portion 67 and is bent further at a sharp angle to form the top reinforcing strip 68 within lip 71. This greatly strengthens the end of the panel as supported on the beam 63. A usual top cementitious floor 69 may then be poured over this entire structure.

The channel 63 may also be used as a permanent formwork to make a solid beam by reversing it as shown in FIG. 17. The topping concrete 72 is then poured over the floor panel 10 and into the interior of the beam 63 to form a complete structure as shown in FIG. 17. For longer spans and greater strength the arrangement of FIG. 17 may be designed as shown in FIG. 18 where the entire member 10 is placed on top of beam 63, thereby giving greater support strength between the panels 10 and the beam 63 and also providing a deeper filled concrete portion 73 to the beam 63.

When girders and beams for even longer spans are required, the system can be arranged as shown in FIG. 19. Here, we see the channels of the invention used for support in two directions with the panels 10 serving as cross supports between channel members. The entire top surface is again covered and the gaps filled by means of concrete 74.

I claim:

1. A precast building construction element comprising a panel unit of set cementitious material having at least one integrally formed set cementitious projection extending along the length thereof and a metal reinforcing strip mechanically embedded in the edge of said projection remote from said panel, said reinforcing strip comprising an elongated unitary strip made from about 14–30 gauge sheet steel having a substantially flat central web portion, with the side edges of said web merging by way of rounded corners of small radius into flanges extending away from said web, at least the free longitudinal edges of said flanges being inclined inwardly, said longitudinal flange edges having longitudinally spaced rounded depressions of small radius pressed downwardly therein, said depressions causing associated deformation of the flanges less than the full depth of the flanges, leaving substantially undeformed longitudinal portions of the flanges adjacent the central web, and the portions of said longitudinal flange edges between said rounded depressions being outwardly bowed, whereby a double curvature is developed with substantially all the flange areas being curvilinear and more than 50% of a cross-section through the strip being curved, thereby providing maximum membrane resistance within said strip with minimum bending or flexing stresses, and said reinforcing strip being embedded with flanges of the strip embedded in the cementitious material and the central web portion adjacent the element edge face.

2. A construction element according to claim 1 wherein said projection has inclined side walls terminating in an end edge containing said reinforcing strip.

3. A construction element according to claim 2 wherein said projection has parallel side walls adjacent the panel, said parallel side walls terminating at their outer ends in outwardly directed ledge portions forming part of an enlarged outer portion, with the outer edge of said outer portion containing said reinforcing strip.

4. A construction element according to claim 3 wherein rigid cellular insulation blocks are fixed between said panel face and said ledge portions.

5. A construction element according to claim 4 wherein said enlarged outer portion has inwardly tapering side walls between said ledge portions an said outer edge.

* * * * *